US005306210A

United States Patent [19]

Smit

[11] Patent Number: 5,306,210

[45] Date of Patent: Apr. 26, 1994

[54] LOUVRE TYPE ROOF STRUCTURES

[76] Inventor: Dirk V. Z. Smit, P.O. Box 13869, Sinoville, 0129, South Africa

[21] Appl. No.: 928,789

[22] Filed: Aug. 12, 1992

[30] Foreign Application Priority Data

Aug. 15, 1991 [ZA] South Africa ..... 91/6462

[51] Int. Cl.[5] ..... F24I 7/02

[52] U.S. Cl. ..... 454/250; 49/74.1; 52/473; 454/281; 454/358

[58] Field of Search ..... 49/74.1, 79.1, 403; 52/71, 72, 18, 473; 454/250, 275, 276, 278, 281, 314, 358, 367

[56] References Cited

U.S. PATENT DOCUMENTS

| | | | |
|---|---|---|---|
| 1,283,338 | 10/1918 | Simon | 454/358 X |
| 1,408,432 | 3/1922 | Arnold | 454/358 X |
| 2,210,869 | 8/1940 | Larson . | |
| 2,580,933 | 1/1952 | Larson | 49/79.1 |
| 2,647,291 | 8/1953 | Russell . | |
| 2,867,008 | 1/1959 | Soule | 49/79.1 |
| 3,346,007 | 10/1967 | Agnon | 454/278 X |
| 3,741,102 | 6/1973 | Kaiser | 49/74 X |
| 3,803,790 | 4/1974 | Buck et al. | 52/473 |
| 3,866,375 | 2/1975 | Brugman | 52/473 |
| 3,919,814 | 11/1975 | Beretta et al. | 454/278 X |
| 3,982,355 | 9/1976 | Piercey | 49/74.1 |
| 4,038,781 | 8/1977 | Graham | 49/90 X |
| 4,313,650 | 2/1982 | Ward | 350/263 |
| 4,518,012 | 5/1985 | O'Hara | 137/601 |
| 5,020,423 | 6/1991 | Hill | 49/1 |

FOREIGN PATENT DOCUMENTS

| | | | |
|---|---|---|---|
| 897172 | 5/1962 | United Kingdom | 454/358 |

*Primary Examiner*—Harold Joyce

*Attorney, Agent, or Firm*—Harness, Dickey & Pierce

[57] ABSTRACT

A louvre type roof structure including a plurality of parallel slats mounted on carrier beams extending transversely to the slats, in which the slats are mounted on carrier elements which are in turn mounted on the carrier beams to permit pivotal displacement of the carrier elements and of the slats between a closed position in which they are disposed in a roughly coplanar position, and an open position in which they are disposed in spaced apart parallel planes. The carrier elements are secured to the slats by means of lugs engaging the slats without penetrating the slats. The carrier elements are mounted on the carrier beams by mounting levers, a pair of mounting levers being provided in respect of each carrier element, one of a pair of levers being a fixed lever and being secured to the carrier beam in a fixed position, and the other one being a free lever and being displaceable relative to the carrier beam.

14 Claims, 4 Drawing Sheets

LOUVRE TYPE ROOF STRUCTURES

THIS INVENTION relates to adjustable roof structures. More particularly the invention relates to louvre type roof structures, to component parts for constructing such roof structures, and to a method for their construction.

Louvre type roof structures generally comprise a plurality of parallel strips or slats which are mounted to be displaceable between a closed position in which the slats are disposed in a continuous and roughly coplanar configuration, and an open position in which individual slats are disposed at an angle and in spaced apart parallel planes, to define openings between them through which air, light and sun, etc may pass. Usually the angle may be varied, to vary the dimensions and angular configuration of the intermediate openings.

According to the invention there is provided a louvre type roof structure including a plurality of parallel slats mounted on carrier beams extending transversely to the slats, in which the slats are mounted on carrier elements, which carrier elements are in turn mounted on the carrier beams to permit pivotal displacement of the carrier elements and of the slats between a closed position in which they are disposed in a roughly coplanar position, and an open position in which they are disposed in spaced apart parallel planes, the carrier elements further being secured to the slats by means of securing means engaging the slats without penetrating said slats and in such a manner that a slat will be located in a fixed planar position relative to a carrier element to which it is secured.

In practice the arrangement will be such that displacement of the carrier elements from a closed to an open position will bring about displacement of the louvre slats from a closed position, in which the slats are disposed in a continuous and roughly coplanar horizontal configuration, to an open position in which the louvre slats are disposed in spaced apart parallel planes at an angle to the horizontal to define openings between them.

The carrier elements may be mounted on the carrier beams by means of mounting levers, a pair of mounting levers being provided in respect of each carrier element, one of a pair of levers being a fixed lever and being secured to the carrier beam in a fixed position, and the other one being a free lever and being displaceable relative to the carrier beam, the fixed lever of a pair further being rotatably attached to its carrier element and the free lever of a pair being fixedly attached to its carrier element to permit pivotal displacement of the carrier element when the free lever is displaced relative to the carrier beam.

As indicated above, it is a feature of the invention that the carrier elements are adapted to be secured to the slats without the aid of rivets or bolts or like securing means, so that the slats are not penetrated. To this end the carrier elements may be provided with securing lugs to engage with the edges of the slats to secure the slats on the carrier elements, as described in more detail below.

The slats may be of any suitable profile to provide them with a suitable degree of rigidity along their length, and to present adequate water gullies so as to enable a substantially leak-free roof structure to be formed by the slats when they are in the closed position. For example, a slat may have an undulating profile to define a longitudinally extending leading edge section having a raised configuration to present a downwardly extending peripheral area terminating in a folded-under peripheral edge. The trailing edge section of the slat may have a depressed configuration to present an upwardly directed peripheral area also terminating in a folded-under peripheral edge.

When used for a roof construction, the carrier elements may be so positioned and the slats may be so arranged that in the closed position the downwardly directed leading edge section of a slat will overlap with and extend over the upwardly directed trailing edge section of the slat immediately adjacent and in front of the first-mentioned slat. The overlapping peripheral areas may in practice engage to provide a sturdy and substantially watertight roof structure.

The carrier elements may be provided with lug formations to engage within the folded-under peripheral edge formations of the slats. If desired, the carrier elements may be provided with further lug formations arranged to be deformed around the peripheral edges of a slat, to engage securely with the slat.

A carrier element may comprise an elongated body part, preferably having an upper face configured to correspond generally with the profile of a slat, the body part being intended to support the louvre slat; a front or leading end profiled to conform substantially to the corresponding leading edge section of a slat and having a lug formation to engage within the folded-under edge formation of the leading edge of the slat; a rear or trailing end likewise profiled to conform substantially to the corresponding trailing edge section of the slat, and having a lug formation to engage within the folded-under edge formation of the trailing edge of the slat; and further lug formations to engage around at least one of the edges of the slat; and having a wing part intended in use to be disposed roughly perpendicular to the body part, the arrangement being such that the fixed and free levers will be secured to the wing part in a position intermediate of the ends of the carrier element.

In order to ensure that the carrier elements will all be positioned in the correct and desired alignment with the other carrier elements, a pair of securing holes may be punched in the wing part to correspond exactly with a pair of holes punched in the free lever. By securing the free lever to the carrier element through corresponding holes, the desired alignment may be achieved.

The fixed lever of each pair of mounting levers may be mounted on the carrier beam in a fixed substantially upright position, the fixed lever having a first fixed end fixedly attached to the carrier beam and a second end rotatably attached, such as with a rivet, to the carrier element to permit pivotal movement of the carrier element relative to the fixed lever. The free lever of each pair may have a first fixed end, conveniently its upper end, fixedly attached, such as with rivets, to the carrier element while its lower end may be free to carry out reciprocal arcuate movement. The arrangement may be such that reciprocal arcuate movement imparted to the free end of the free lever will bring about pivotal displacement of the carrier element about a substantially horizontal axis, between the aforesaid open and closed positions.

A plurality of pairs of mounting levers may be provided on a carrier beam, spaced along its length at suitable intervals, so that a plurality of spaced carrier elements will be carried on a carrier beam. In constructing a roof structure, two or more carrier beams may be provided adjacent one another in spaced parallel relationship, and louvre slats may be mounted on aligned carrier elements on adjacent carrier beams, to extend substantially at right angles to the length of the carrier beams.

According to a further feature of the invention, the free lower ends of all the free levers operating on a carrier beam may be interconnected by means of an elongated connector, so that reciprocal displacement of the connector will impart reciprocal arcuate movement to the free levers to bring about pivotal displacement of all the carrier elements carried on that carrier beam, and thus of the louvre slats mounted on the carrier elements.

It will be evident that the carrier beams and carrier elements should be mounted in such a manner that the carrier elements will be properly aligned and substantially coplanar, so that the louvre slats mounted thereon will be properly aligned and in the desired relative positions, to overlap in the correct manner when they are in the closed position.

The carrier beams may in turn be supported on support beams which may be arranged transversely to the carrier beams. The support beams may be mounted on suitable support structures, such as pillars or against a wall or the like. The invention envisages the provision of suitably designed brackets by means of which the support beams may be mounted against a wall, on a pillar or wall, etc.

Reverting again to the mounting levers and the manner in which the levers may be activated to bring about pivotal displacement of the carrier elements and the louvre slats, reciprocal displacement of the connector may be brought about by imparting rotational movement to a rotation rod operatively connected to one or more selected sets of mounting levers. For example, a rotation rod may be provided to extend between selected aligned mounting levers on adjacent carrier beams, the rotation rod being secured to the selected mounting levers in such a manner that rotational motion of the rod around its longitudinal axis will bring about arcuate movement of the free levers of the aligned pairs of mounting levers, thereby imparting linear displacement to the connectors interconnecting the free levers carried on a carrier beam, so as to bring about pivotal displacement of the interconnected free levers, the carrier elements and thus of the louvre slats.

The selected pairs of mounting levers on which the rotation rod is to operate may in practice be modified to mount the rotation rod. One way of modifying the mounting levers will be described in more detail further on.

The placement and positioning of the rotation rod, and thus the selection of the pairs of mounting levers to be modified, will be determined with reference to the size and configuration of the roof structure, and the number and size of sections into which the roof area will be divided, each of which sections will be operated as a unit. If the roof is wide so that the louvre slats are long, a section will include fewer louvre slats. Conversely, if the slats are shorter, a section may include more slats. All the slats within a section will be operated simultaneously by means of a single rotation rod.

An activating arm may be provided by means of which rotational movement may be imparted to the rotation rod. The activating arm may be removable, and may comprise a rod of suitable length, one end being shaped to co-operate with an engagement means provided on the rotation rod, so that the activating arm may be engaged with the rotation rod and manipulated to impart rotational motion to the rotation rod. The engagement means may be co-operating socket and spigot formations provided on the activating arm and the rotation rod respectively.

The free edges of a roof structure constructed in accordance with the invention may be finished off by a fascia surround. To this end a fascia mounting support may be provided, the fascia support comprising a rod intended to be mounted in an upright position, the rod carrying one or more deforable snap-fit mounting means on which one or more suitable profiled fascia panels may be mounted.

In one embodiment, a fascia support may be provided with one or more, conveniently three, deformable loop-shaped mounting formations, on which formations the corresponding number of fascia panels may be mounted. The fascia panels may be profiled to enable the mounting formations to engage with the panels, for example by having turned-back edge formations defining channels within which the mounting formations may engage. The loop-shaped mounting formations may be formed of resilient metal strips formed into angular loops and secured on the fascia support, the arrangement being such that the angled parts of the loop formations will be able to be snap-fitted into the channel formations of the fascia panels, to mount the panels on the fascia support.

It should be understood that fascia boards of other materials, eg asbestos or wood, may also be used. In such a case the boards may be secured to the fascia support in any suitable manner.

A fascia support may in turn be fastened to a carrier beam by means of a suitable mounting bracket, a mounting bracket including an arm having an angled clamp formation at one end to engage around a carrier beam, where it may be fastened by means of a self-drill screw, bolt, rivet or the like. The opposed end of the arm may have a mounting formation on which the fascia support may be mounted, e.g. with rivets, self-drill screws, bolts or the like.

The arm of the bracket may be of suitable dimensions to support a gutter between the fascias and the edge of the roof structure.

The invention extends also to the various structural elements and component parts as described herein, and which are suitable for and intended for the construction of a louvre type roof structure in accordance with the invention. The various components may conveniently be cut from suitable steel plate by means of specially designed punch and die sets. For example, the mounting levers may be cut from 3 mm mild steel. The blanks from which the carrier elements may be formed, may be cut from 0.06 mm special coated steel, such as the coated steel available under the trade name Chromadek (Iscor). The carrier elements, louvre slats and fascia panels may also be made of aluminium plate.

In particular the invention envisages the provision of prefabricated carrier beams of suitable length, provided with a plurality of pairs of mounting levers spaced at suitable intervals along the length thereof, and with the free ends of the free levers secured to a connector rod. On site, where the roof structure is to be constructed, the carrier beams may be cut to the required length prior to installation. If desired, carrier elements may also be provided on the mounting levers beforehand. Alternatively, the carrier elements may be mounted on site.

The rotation rod may be mounted on site, by modifying those pairs of mounting levers on the different carrier beams where the rotation rod is to be positioned. This may be achieved by modifying the fixed lever in such a manner that it can support the rotation rod to permit rotational movement thereof, and by modifying the free lever in such a manner that it can carry a carrier element and can transfer rotational movement of the rotation rod as pivotal movement to the carrier element. According to the invention there may be provided for this purpose suitable rotation rod support elements comprising an apertured part or a tubular part of diametral dimensions to receive the rotation rod, and an attachment part, e.g. a bifurcated part adapted to straddle the free end of a fixed or free lever and to be secured thereto such as with rivets.

The free ends of the fixed and free levers may be cut away so that the modified levers will be properly aligned with the other unmodified levers. The support element provided on the free lever may include locking means such as a grub screw to enable the rotation rod to be locked in position, so that rotational motion of the rotation rod will be transferred via the modified free lever as pivotal movement to the carrier element and as reciprocal movement to the connector and thus to the other free levers, to bring about pivotal displacement of all the carrier elements. The support element may be provided with mounting means such as a mounting bracket or plate, on which the carrier element may be mounted. The mounting plate should be so positioned that the carrier element will be located in the correct position, in alignment with other carrier elements.

Instead of modifying the free lever, the entire free lever may be replaced by a special rotation lever, which comprises a lever part to be secured to the connector, a tubular part to receive the rotation rod, a mounting plate on which the carrier element may be mounted, and a grub screw on the tubular part to lock the rotation rod in position relative to the rotation lever. The entire unit, with the carrier element already mounted thereon, may be prefabricated, to be substituted for the free lever where the rotation rod is to be placed.

This feature, namely that the rotation rod may be placed in the desired position on site, by modifying and/or replacing the mounting levers, enables an individually designed roof structure to be erected on site with the aid of prefabricated standard components. The invention accordingly provides a method of constructing a louvre type roof according to the invention, which includes the steps of providing standard lengths of prefabricated carrier beams as claimed in claim 22, cutting the carrier beams to suitable lengths with reference to measurements of the desired roof structure taken on site, determining a suitable position on the carrier beams for a rotation rod with reference to the measurements taken, selecting pairs of aligned mounting levers in a suitable position on the carrier beams to support the rotation rod, modifying the selected pairs of mounting levers to support the rotation rod, and erecting the roof structure with the aid of such cut and modified carrier beams.

According to the invention it is also envisaged to provide a mobile construction unit equipped with prefabricated components and with the necessary tools and equipment to enable components to be manufactured, assembled, modified and erected on site, to construct a louvre type roof structure of the desired design and dimensions on site from standard component parts. The mobile unit may for example be equipped with suitable profiling machines, so that the required lengths of lourve slats and fascia panels may be profiled on site, e.g. from coils of flat steel strip. The required lengths of carrier beams may be cut on site from standard lengths prefabricated with mounting levers, connectors, and carrier elements mounted thereon.

The invention and the manner in which it may be put into practice will now be described by way of example with reference to the accompanying diagrammatic drawings.

In the drawings

Figure 1:
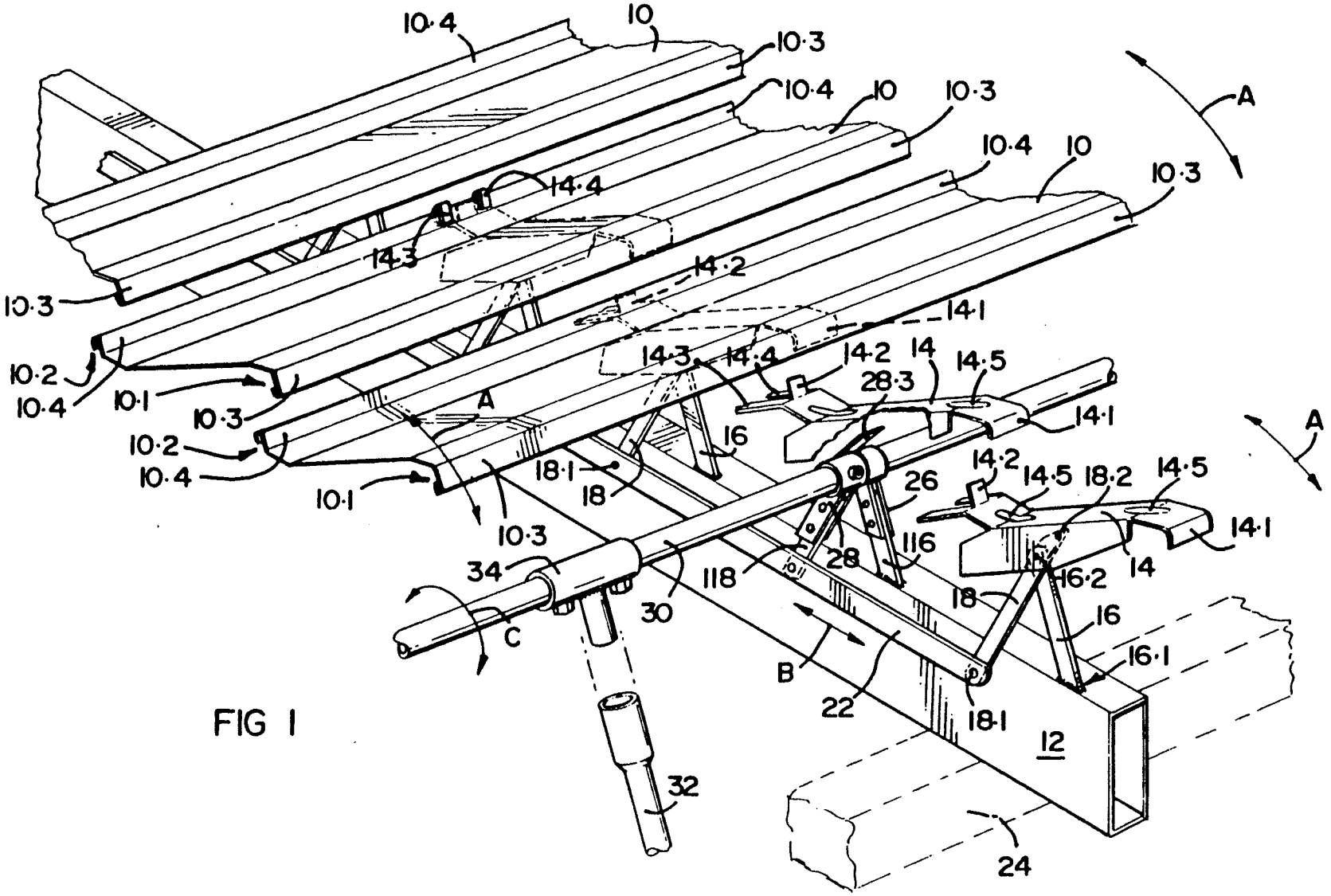
FIG. 1 is a partial three-dimensional representation depicting a part of a louvre type roof structure according to the invention.

Referring to the drawings, a louvre type roof structure according to the invention comprises a plurality of parallel louvre slats 10 mounted on carrier beams 12 extending transversely to the slats 10, by means of carrier elements 14. The carrier elements 14 are mounted on the carrier beams 12 by means of pairs of mounting levers comprising a fixed lever 16 and a free lever 18.

As will be described in more detail below, the carrier elements 14 are capable of pivotal movement in the direction of the arrows A shown in FIGS. 1, 2 and 13, to bring about pivotal movement of the louvre slats 10 in the direction of the arrows A. The result is that the louvre slats 10 can be displaced from a closed position, as shown in broken lines in FIG. 2, in which the slats 10 are disposed in a continuous and roughly coplanar horizontal configuration, to an open position as shown in full lines in FIG. 2, in which the slats 10 are disposed at an angle to the horizontal and in spaced apart parallel planes, defining openings 20 between them.

Figure 2:
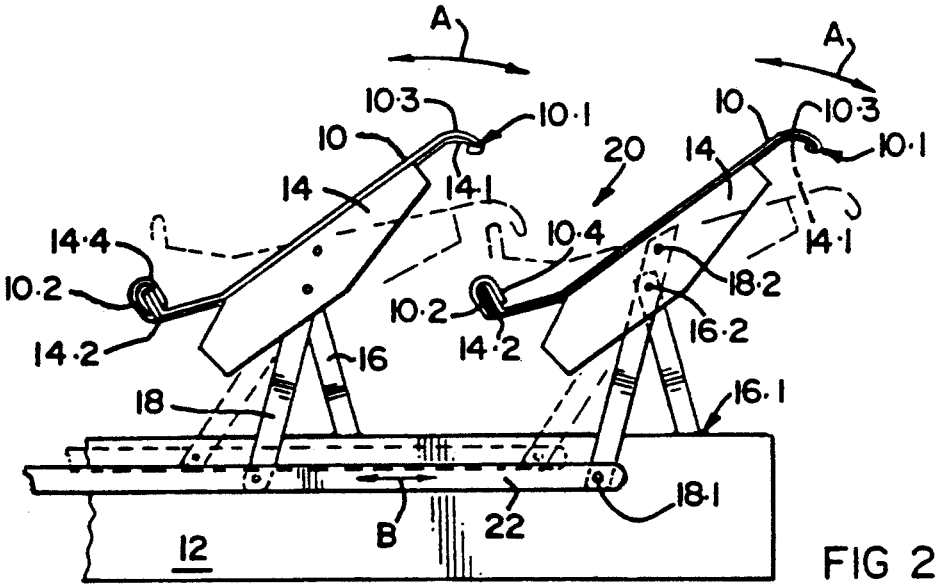
FIG. 2 is a partial side view of part of a carrier beam carrying the carrier elements, to illustrate the pivotal displacement of the carrier elements.

In the embodiment depicted in FIGS. 1 and 2, the fixed mounting lever 16 is fixedly mounted on the carrier beam 12 at its one end, as shown at 16.1, while its other end is rotatably secured to the carrier element 14 by means of a rivet, as shown at 16.2. The free lever 18, on the other hand, is rotatably secured at its lower end to a connector rod 22, as shown at 18.1, while its other end is fixedly secured to the carrier element 14 at 18.2, and to both the carrier element 14 and the fixed lever 16 at 16.2, so as to permit pivotal movement of the free lever 18 and the carrier element 14 about the axis 16.2. It will be evident that reciprocal movement of the connector 22 in the direction of the arrow B shown in FIGS. 1, 2 and 13 will bring about pivotal movement of the carrier elements 14, and thus also of the louvre slats 10, in the direction of the arrows A.

Although the connector 22 is depicted in FIGS. 1 and 2 as being disposed at one side of the carrier beam 12, it is also possible, and would indeed be desirable, to position the connector 22 above the carrier beam 12, a configuration which would facilitate installation in close proximity to side walls. The placement of guttering would also be facilitated. Such an embodiment is illustrated in FIG. 13. It will be noted that the free lever 18 in this case is shorter. It may also be necessary to adjust the angle of the free lever 18 relative to the carrier element 14.

The louvre slats 10 are mounted by means of the carrier elements 14 in such a manner that no bolts or rivets or the like are required, so that the slats 10 are not penetrated. As shown in FIGS. 1, 2 and 13, the carrier elements 14 are so designed and shaped, that their leading ends 14.1 will engage within channel formations formed by the folded-under leading edge of the slats 10, as shown at 10.1. The rear ends of the carrier elements 14 are formed with lugs 14.2 adapted to engage within channel formations formed by the folded-under trailing edge of the slats 10, as shown at 10.2. Depressions 14.5 form reinforcing ribs to provide the carrier elements 14 with greater strength and rigidity.

Further lugs 14.3, 14.4 formed on the rear ends of the carrier elements 14 may be deformed to engage with the trailing edge of the slats 10, e.g. by being bent around said edge, as shown in FIGS. 1 and 2. Alternatively the lugs 14.3, 14.4 may be folded back upon themselves and engaged within the channel formations 10.2 formed in the slats 10.

Figure 10:
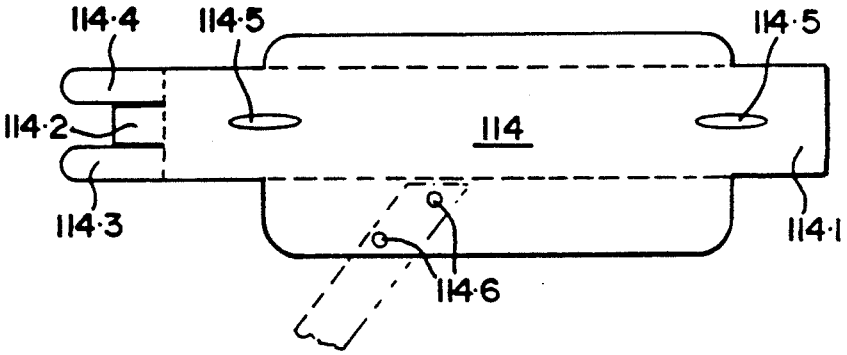
FIG. 10 is a diagrammatic plan view of a blank cutout of steel plate, intended to form a carrier element.

A blank cut from steel plate and suitable for the formation of a carrier element 114 of slightly different configuration, is illustrated in FIG. 10. The carrier element will be formed by deforming the blank along the fold lines shown in broken lines in FIG. 10. The leading end part 114.1 and rear end part 114.2 will engage within the channel formations 10.1 and 10.2 of the louvre slats 10, as explained above. The lugs 114.3, 114.4 will be bent to engage around the edge of the slats 10. Reinforcing formations 114.5 are again provided, and holes 114.6 are punched in the correct position to secure the levers 16, 18.

Figure 11:
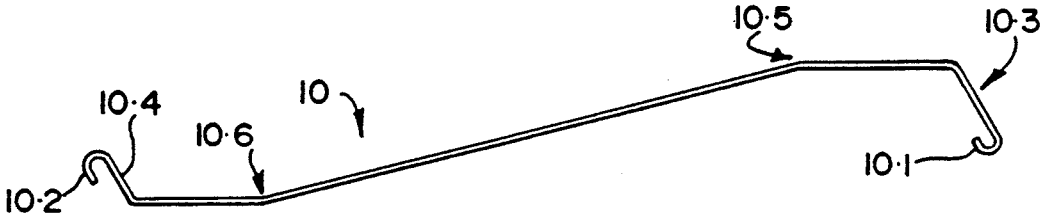
FIG. 11 is a cross-section through a louvre slat, to illustrate its profile.

The louvre slats 10 may be of suitable profile, as depicted in FIGS. 1 and 11, to provide them with the required degree of rigidity, and to provide a substantially leak-free roof structure. As shown in FIGS. 1 and 11, the slats 10 have a raised part 10.5 with a downwardly extending leading peripheral area 10.3 terminating in a folded-under leading edge as shown at 10.1, and a depressed part 10.6 with an upwardly directed trailing peripheral area 10.4 also terminating in a folded-under trailing edge 10.2. The depressed part 10.6 constitutes a deep gully within which rain water may accumulate to be led away. The leading area 10.3 will overlap with the upwardly directed trailing peripheral area 10.4 of the adjacent slat when the slats are in the closed position. The overlapping peripheral areas will in practice engage to provide a sturdy and substantially water-tight roof structure.

Figure 3:
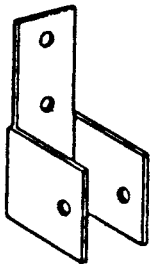
FIGS. 3, 4, 5 and 6 are three-dimensional representations of different mounting brackets for mounting support beams for the roof structure on different supports.
Figure 4:
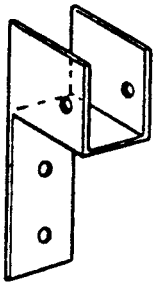
Figure 5:
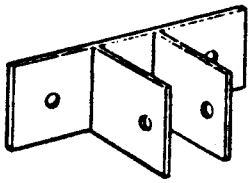
Figure 6:
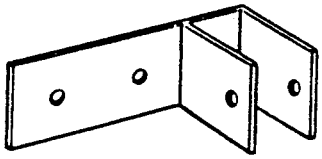
Figure 12:
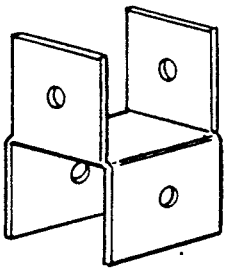
FIG. 12 is a three-dimensional representation of a cross clamp for mounting a carrier beam on a support beam.

The carrier beams 12 may themselves be supported on support beams 24 which are disposed transversely to the carrier beams, and only one of which is partly depicted in broken lines in FIG. 1. A cross clamp as depicted in FIG. 12 may be positioned between a carrier beam 12 and a support beam 24. By means of such a cross clamp the elevation of the carrier beam 12 relative to the support beam 24 may be adjusted. The support beams 24 may in turn be mounted against a wall, e.g. with a mounting bracket as depicted in FIG. 3; or on a pillar, e.g. with a mounting bracket as depicted in FIG. 4; or in other suitable positions against an upright support by means of the versatile mounting brackets as depicted in FIGS. 5 and 6.

Figure 13:
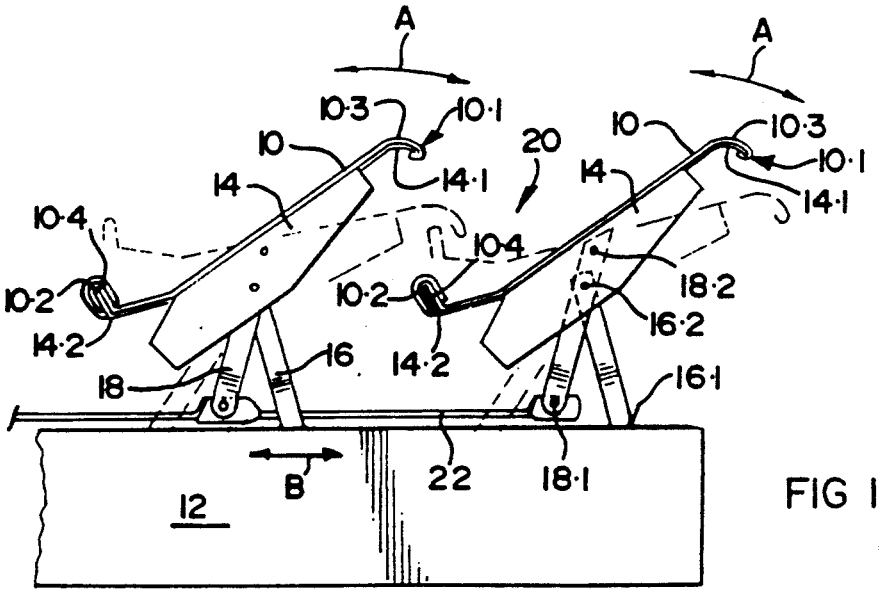
FIG. 13 is a partial side view of part of a carrier beam and carrier elements, to illustrate an alternative placement of the connector.

To bring about the pivotal displacement of the carrier elements 14 and the louvre slats 10, in the direction of the arrows A in FIGS. 1, 2 and 13, the free levers 18 and the connector 22 connecting them together have to be displaced reciprocally in the direction of the arrow B in FIGS. 1, 2 and 13. This is brought about by means of a rotation rod 30 operatively connected to the levers 16, 18. To support the rotation rod 30, the levers 116, 118 located in the relevant position may be modified, as will be described below.

Figure 8:
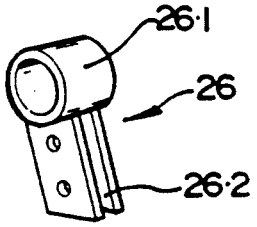

The fixed lever 116 may be cut back and a rotation rod support element 26 mounted thereon. The rotation support element 26 is illustrated in FIG. 8, and it comprises a tubular part 26.1 of diametral dimensions to receive the rotation rod 30, and a bifurcated part 26.2 adapted to straddle the fixed lever 116 and to be secured thereto such as by rivets.

Figure 9:
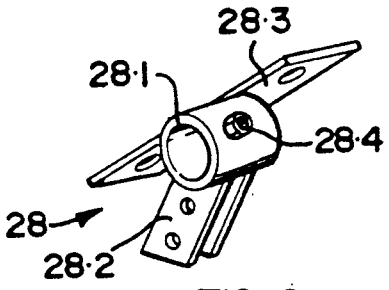
FIGS. 8 and 9 are three-dimensional representations depicting optional rotation rod support elements.

The free lever 118 may likewise be provided with a rotation support element 28 as illustrated in FIG. 9, and comprising a tubular part 28.1 to receive the rotation rod 30; a bifurcated part 28.2 for attachment to the lever 118; a plate 28.3 on which the carrier element 14 is to be mounted; and a grub screw 28.4 by means of which the rod 30 may be locked to the support element 28.

It should be understood that the rotation rod support elements illustrated as 26, 28 may vary in shape and design in practice. However, the support elements will always have a tubular or similar support means for supporting the rotation rod 30, and a bracket or similar attachment means for attachment to a fixed or free lever. As mentioned before, it is also possible for a modified free lever to be provided, which may be mounted to replace an ordinary free lever, to support the rotation rod 30.

Figure 14:
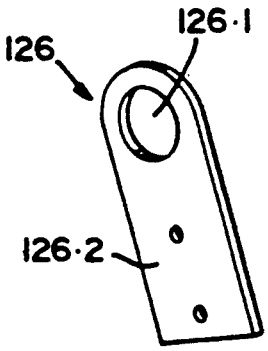
FIGS. 14 and 15 are three-dimensional representations depicting alternative embodiments of rotation rod support elements.
Figure 15:
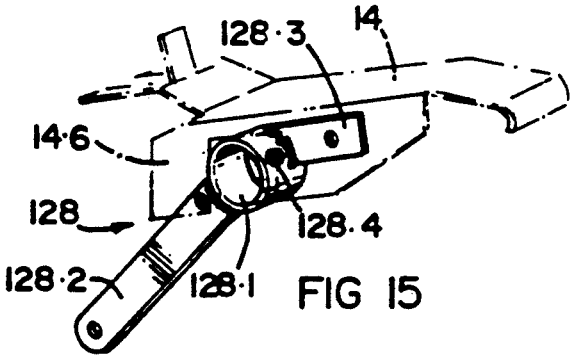

In FIGS. 14 and 15 alternative embodiments of rotation rod support elements are illustrated, indicated as 126 and 128 respectively. The element 126 comprises a flat bracket 126.2 provided with a circular aperture 126.1 to receive the rotation rod 30, the bracket 126.2 being intended to be placed against the fixed lever 116 and to be secured thereto such as by rivets.

The support element 128 illustrated in FIG. 15 is in fact a modified free lever and is intended to replace the lever 118 as shown in FIG. 1. The modified free lever comprises a tubular part 128.1 to receive the rotation rod 30; a plate 128.3 on which the carrier element 14 is mounted; a grub screw 128.4 for locking the element 128 onto the rotation rod 30; and a lever part 128.2 to serve as the free lever. To secure the carrier element 14, a further rivet (not shown) may pass through the lever 128.2 and the wing part 14.6 of the carrier element 14.

It will be evident that rotational motion of the rod 30 in the direction of the arrows C in FIG. 1, will bring about reciprocal displacement of the connector 22 in the direction of the arrows B, and ultimately pivotal displacement of the carrier elements 14 and the slats 10 in the direction of the arrows A.

Rotational movement may be imparted to the rod 30 by means of an activating arm 32 co-operating with an engagement device 34 mounted on the rod 30, by means of spigot and socket formations. The engagement device 34 may also serve as a connecting piece to connect together two sections of a rotation rod 30. It may in practice be advantageous to provide the rotation rod in sections, e.g. where the space is insufficient to allow the placement of rods of substantial length.

Figure 7:
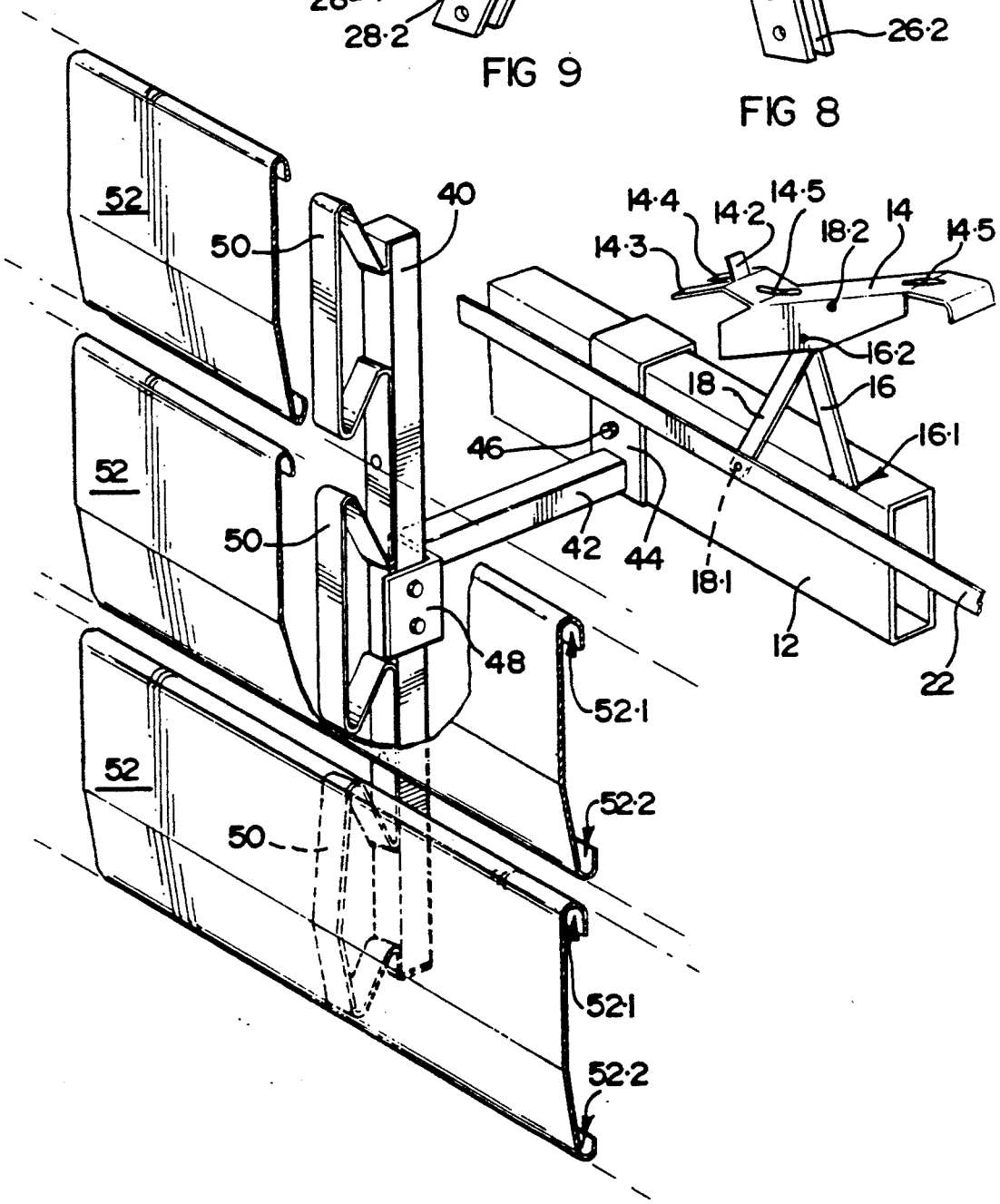
FIG. 7 is a partial three-dimensional representation depicting a part of a fascia structure in relation to part of a carrier beam.

The free edges of a roof structure according to the invention may be finished off by means of a fascia structure as illustrated in FIG. 7. A fascia mounting support 40 is provided in the form of a rod intended to be mounted in an upright position by means of a mounting bracket 42. The mounting bracket 42 is in the form of an arm with an angled clamp formation 44 at one end, adapted to engage around a carrier beam 12, where it may be secured such as by means of a self-drill screw 46. An angled mounting formation 48 is provided at the other end of the arm 42 and is fastened to the fascia mounting support 40. A gutter (not shown) may be supported on the bracket arm 42, between the carrier beam 12 and the fascia panels.

The fascia mounting support 40 carries a number of deformable snap-fit mounting loops 50, formed of a strip of resilient steel. Fascia panels 52 are provided, which are profiled to present turned-back edge formations 52.1, 52.2 forming channel formations within which the mounting loops 50 may engage with a snap-fit action. The fascia mounting support 40 thus provides a simple and quick means for mounting the fascia panels 52.

The Applicant believes that many advantages are inherent in his concept of providing a mobile unit suitably equipped to enable individually designed roof structures to be erected by means of standard prefabricated component parts, by suitably modifying these component parts on site, and by manufacturing on site certain other component parts from supplies of suitable blank or basic materials with the aid of suitable equipment, all of which are provided in a mobile unit. In this manner tailor-made roof structures may be erected quickly and without the delay inherent in having to have specially designed component parts made up in a factory. This procedure also enables roof structures to be erected in remote localities from available basic and standard components, thus achieving a savings in costs.

The invention accordingly extends to a method of erecting roof structures as described herein, and in particular by using standard and basic components to be modified or prepared and assembled on site with the aid of equipment carried in a mobile unit.

The particular roof system and its component parts as provided by Applicant also involve specific advantages. Thus, since the louvre slats are mounted without penetration by rivets or bolts, installation time is shorter, and the risk of corrosion or leakage is eliminated or at least reduced. Accordingly, a structure of greater durability may be provided.

I claim:

1. A louvre type roof structure which includes a plurality of parallel slats mounted on carrier beams extending transversely to the slats, in which the slats are mounted on carrier elements which carrier elements are in turn mounted on the carrier beams by means of mounting levers, a pair of mounting levers being provided in respect of each carrier element, one of a pair of mounting levers being a fixed lever and being secured to a carrier beam in a fixed position, and the other one of the pair of mounting levers being a free lever and being displaceable relative to the carrier beam, the fixed lever of a pair further being rotatably attached to a carrier element and the free lever of a pair being fixedly attached to the carrier element, to permit pivotal displacement of the carrier element when the free lever is displaced relative to the carrier beam, the carrier elements further being secured to the slats by means of securing means engaging the slats without penetrating said slats and in such a manner that a slat will be located in a fixed planar position relative to the carrier elements to which it is secured, the arrangement being such that pivotal displacement of the carrier elements will bring about pivotal displacement of the slats between a closed position in which the slats are disposed in a roughly coplanar configuration, and an open position in which they are disposed in spaced apart parallel planes.

2. A roof structure according to claim 1, wherein the fixed lever of a pair of mounting levers has a first fixed end fixedly attached to the carrier beam, and a second end rotatably attached to the carrier element to permit pivotal movement of the carrier element relative to the fixed lever; and wherein the free lever of a pair of mounting levers has a first fixed end fixedly attached to the carrier element, and a second free end free to carry out reciprocal arcuate movement; the arrangement being such that reciprocal arcuate movement imparted to the free ends of the free levers of a plurality of carrier elements brings about pivotal displacement of the carrier elements which in turn brings about pivotal displacement of the slats between the aforesaid open and closed position.

3. A roof structure according to claim 2, wherein a plurality of pairs of mounting levers are provided on a carrier beam, spaced along its length at suitable intervals, to carry a plurality of spaced carrier elements on the carrier beam.

4. A roof structure according to claim 3, wherein the free ends of the free levers operating on a carrier beam are interconnected by means of an elongated connector; the arrangement being such that reciprocal displacement of the connector imparts reciprocal arcuate movement to the free levers to bring about pivotal displacement of the carrier elements carried on the carrier beam, and thus of the slats mounted on the carrier elements.

5. A roof structure according to claim 4, wherein a plurality of carrier beams are provided adjacent one another in spaced parallel relationship, each carrier beam carrying a plurality of pairs of mounting levers spaced along its length such that pairs of mounting levers on adjacent carrier beams are substantially aligned, and wherein a rotation rod is provided to extend between selected aligned pairs of mounting levers on adjacent carrier beams, the rotation rod being secured to the selected mounting levers in such a manner that rotational motion of the rod around a longitudinal axis will bring about arcuate movement of the free levers of the aligned pairs of mounting levers, thereby imparting linear displacement to the connectors interconnecting the free levers carried on a carrier beam, so as to bring about simultaneous pivotal displacement of the interconnected free levers, of the carrier elements and thus of the slats.

6. A roof structure according to claim 5, wherein the fixed lever of each selected pair of mounting levers is modified to support the rotation rod to permit rotational motion of the rod, and wherein the free lever of each selected pair of mounting levers is modified to support the rotation rod in fixed relationship and to carry also a carrier element, so that rotational motion of the rotation rod is transferred as pivotal movement to the carrier element.

7. A roof structure according to claim 6, which includes rotation rod support elements for modifying the fixed and free levers of the selected pairs of mounting levers, a rotation rod support element comprising a tubular part of diametric dimensions to receive the rotation rod, and a bifurcated attachment part adapted to straddle a fixed or free lever and to be secured thereto, and in which a rotational support element provided on a free lever includes a locking means for locking a rotation rod in position, and a mounting bracket on which a carrier element is mountable, so that rotational motion of the rotation rod will be transferred via the modified free level as pivotal movement to the carrier element and as reciprocal movement to the connector.

8. A roof structure according to claim 1, wherein a slat has an undulating profile to define a longitudinally extending leading edge section which will in use be displaced in a generally upwardly direction during pivotal displacement of the slat to the open position and which has a raised configuration to present a downwardly extending peripheral area terminating in a folded-under peripheral leading edge, and a longitudinally extending trailing edge section which will in use be displaced in a generally downwardly direction during pivotal displacement of the slat to the open position and which has a depressed configuration to present an upwardly directed peripheral area terminating in a folded-under peripheral trailing edge, the carrier elements being so positioned that in the closed position of the slats the downwardly extending peripheral area of the leading edge section of a slat overlaps with and extends over the upwardly directed peripheral area of the trailing edge section of the slat immediately adjacent to it, so as to provide a continuous and closed roof; and in which a carrier element comprises an elongated body part having an upper face configured to correspond generally with the profile of a slat, the body part being intended to support the slat; a leading end profiled to conform substantially to the corresponding leading edge section of a slat and having a securing lug to engage within the folded-under peripheral leading edge of the slat; a trailing end profiled to conform substantially to the corresponding trailing edge section of the slat, and having a first securing lug to engage within the folded-under peripheral trailing edge of the slat and a further lug formation to engage around the peripheral trailing edge of the slat; and a wing part intended in use to be positioned roughly perpendicularly to the body part, the arrangement being such that the fixed and free levers of a pair of mounting levers are secured to the wing part in a position intermediate of the ends of the carrier element.

9. A roof structure according to claim 5, wherein the carrier beams are supported on support beams arranged transversely to the carrier beams.

10. A roof structure according to claim 1, wherein free edges of the roof structure are finished off by a fascia surround, and wherein a fascia mounting support is provided comprising a rod mounted in a substantially upright position, the rod carrying at least one deformable snap-fit mounting means on which a profiled fascia panel is mountable, the fascia panel being profiled with turned-back edge formations defining channels within which the mounting means are engageable, and the deformable mounting means comprising loop-shaped mounting formations formed of resilient metal strips formed into angular loops having angled sections and secured on the fascia mounting support, the arrangement being such that the angled sections of the loops snap-fit into the channels formed in the fascia panels, to mount the panels on the fascia support.

11. A roof structure according to claim 10, wherein the fascia mounting support is fastened to a carrier beam by means of a suitable mounting bracket, the mounting bracket including an arm having a clamp formation at one end to engage around a carrier beam, and a mounting formation on the opposed end on which the fascia mounting support is mounted, and wherein the arm is of suitable longitudinal dimensions to support a gutter between the fascia and the edge of the roof structure.

12. A carrier element for mounting a louvre slat on a carrier beam extending transversely to the slat by means of a pair of mounting levers, one of the pair of mounting levers being a fixed lever and being secured to the carrier beam in a fixed position, and the other one of the pair of mounting levers being a free lever and being displaceable relative to the carrier beam, the fixed lever of the pair further being rotatably attachable to the carrier element and the free lever of the pair being fixedly attachable to the carrier element, to permit pivotal displacement of the carrier element when the free lever is displaced relative to the carrier beam, the carrier element further being secured to the slat in such a manner that the slat will be located in a fixed planar position relative to the carrier element so that pivotal displacement of the carrier element will bring about pivotal displacement of the slat between a closed position and an open position; the slat having an undulating profile to define a longitudinally extending leading edge section which will be displaced in a generally upwardly direction during pivotal displacement of the slat to the open position, which leading edge section has a raised configuration to present a downwardly extending peripheral area terminating in a folded-under peripheral leading edge, and a longitudinally extending trailing edge section which will be displaced in a generally downwardly direction during pivotal displacement of the slat to the open position, which trailing edge section has a depressed configuration to present an upwardly directed peripheral area terminating in a folded-under peripheral trailing edge; the carrier element comprising an elongated body part having an upper face configured to correspond generally with the profile of the slat, the body part being intended to support the slat; a leading end profiled to conform substantially to the corresponding leading edge section of the slat and having a securing lug to engage within the folded-under peripheral leading edge of the slat; a trailing end profiled to conform substantially to the corresponding trailing edge section of the slat, and having a first securing lug to engage within the folded-under peripheral trailing edge of the slat and a further lug formation to engage around the peripheral trailing edge of the slat; and a wing part intended in use to be positioned roughly perpendicularly to the body part.

13. A prefabricated carrier beam carrying a plurality of carrier elements for use in constructing a roof structure which includes a plurality of parallel slats mounted on carrier beams extending transversely to the slats, in which the slats are mounted on carrier elements which carrier elements are in turn mounted on the carrier beams by means of mounting levers, a pair of mounting levers being provided in respect of each carrier element, which prefabricated carrier beam comprises a beam on which are mounted a plurality of pairs of mounting levers spaced at suitable intervals along the length of the beam, one of each pair of levers being a fixed lever and being secured to the carrier beam in a fixed position, and the other one of the pair being a free lever and being displaceable relative to the carrier beam, the fixed lever of each pair further being rotatably attached to one of said carrier elements and the free lever of the pair being fixedly attached to the carrier element, to permit pivotal displacement of the carrier elements when the free levers are displaced relative to the carrier beam, and the free levers of all of the pairs further being secured to an elongated connector; the carrier elements in use being securable to the slats by means of securing means engaging the slats without penetrating said slats and in such a manner that a slat will be located in a fixed planar position relative to the carrier elements to which it is secured.

14. A prefabricated carrier beam according to claim 13, wherein the fixed lever of a pair of mounting levers has a first fixed end fixedly attached to the carrier beam, and a second end rotatably attached to the carrier element to permit pivotal movement of the carrier element relative to the fixed lever; and wherein the free lever of a pair of mounting levers has a first fixed end fixedly attached to the carrier element, and a second free end which is free to carry out reciprocal arcuate movement; and wherein the free ends of all of the free levers are interconnected by means of an elongated connector; the arrangement being such that reciprocal displacement of the connector imparts reciprocal arcuate movement to the free levers to bring about pivotal displacement of the carrier elements carried on the mounting levers.

* * * * *